US005568979A

United States Patent [19]

Fifer et al.

[11] Patent Number: 5,568,979

[45] Date of Patent: Oct. 29, 1996

[54] CLOSEABLE THERMOPLASTIC BAG

[75] Inventors: Larry D. Fifer, Mt. Vernon, Ohio; Robert E. Hollenbeck, Newark, N.Y.; Mark F. Kozlowski, Pittsford, N.Y.; Richard E. Leone, Newark, N.Y.; Clifford H. Patridge, Newark, N.Y.

[73] Assignee: Tenneco Plastics Company, Evanston, Ill.

[21] Appl. No.: 243,357

[22] Filed: May 16, 1994

[51] Int. Cl.[6] ..... B65D 33/16

[52] U.S. Cl. ..... 383/8; 383/15; 383/16; 383/71

[58] Field of Search ..... 383/8, 15, 16, 383/24, 35, 70, 71, 88, 89, 62, 14, 22, 30, 37, 77; 206/554

[56] References Cited

U.S. PATENT DOCUMENTS

| | | | |
|---|---|---|---|
| 3,186,626 | 6/1965 | Shvetz . | |
| 3,820,200 | 6/1974 | Myers . | |
| 3,865,303 | 2/1975 | Korn . | |
| 4,062,392 | 12/1977 | Ishii | 383/16 X |
| 4,174,554 | 11/1979 | Flantua . | |
| 4,273,174 | 6/1981 | Potter . | |
| 4,967,986 | 11/1990 | Schildkraut | 383/30 X |
| 5,044,775 | 9/1991 | Rutledge . | |
| 5,056,934 | 10/1991 | Ielmini et al. | 383/70 |

FOREIGN PATENT DOCUMENTS

| | | | |
|---|---|---|---|
| 1016042 | 10/1952 | France | 383/89 |
| 2687641 | 8/1993 | France | 383/15 |
| 0085159 | 3/1990 | Japan | 383/8 |
| 1067391 | 5/1967 | United Kingdom | 383/71 |
| 1088414 | 10/1967 | United Kingdom | 383/70 |
| 2218684 | 11/1989 | United Kingdom | 383/71 |
| 2273919 | 7/1994 | United Kingdom | 383/71 |

*Primary Examiner*—Jes F. Pascua
*Attorney, Agent, or Firm*—Arnold, White & Durkee

[57] ABSTRACT

A grocery bag or the like having a closure member which securely closes the mouth of the bag so as to prevent items contained therein from falling out when the bag is tipped over. Closure is accomplished by a thin flexible strap attached to the front wall of the bag just below the bag mouth defining an opening between the strap and bag wall. The user may close the bag by inserting the hand through the opening defined by the strap and the bag front wall, grasping the bag handles and pulling the handles through the opening.

20 Claims, 5 Drawing Sheets

CLOSEABLE THERMOPLASTIC BAG

FIELD OF THE INVENTION

This invention relates to thermoplastic film bags, such as undershirt type grocery bags or the like. In particular, it provides a bag closure.

BACKGROUND OF THE INVENTION

Plastic bags are steadily gaining acceptance where consumer goods of all types must be bundled up for transport away from the point of sale. These bags are used in many different types of retail settings to include grocery stores, department stores of all types, building supply stores and any other setting where a lightweight, strong, easy to dispense bag, is required. The advantages of plastic bags over kraft paper bags are numerous. They are lighter in weight, take up less room when folded, resist water, and may be fabricated with integral handles that provide for easy transport of the loaded bag. They are reusable as trash can liners or can be reused to carry other items. Thermoplastic bags are also recyclable.

One disadvantage of plastic bags is their lack of inherent rigidity and ease of closure. The result of this disadvantage is seen in the grocery bag application where it is not unusual for a fully loaded bag to be placed on a consumer's vehicle seat just before leaving with the purchase. As the vehicle turns, the bags typically fall over spilling their contents. The consumer is then faced with the time-consuming and inconvenient task of packing the bag a second time before it can be removed from the vehicle.

There are several disclosures relating to providing a closure for plastic bags or flexible bags of some type. One group of such disclosures addresses the problem by providing a separate closure means or device to secure the bag. U.S. Pat. No. 3,820,200 to Myers discloses a bag closure comprising a flat disc of resilient material provided with an I-shaped slit therein. The end of the bag to be closed is drawn through the slit which grips the bag tightly, achieving closure.

A similar approach is shown in U.S. Pat. No. 4,174,554 to Flantua which discloses a closure having a base portion and a tongue portion. This device is wrapped around the bunched together bag sides which are trapped between the base and tongue portions. Closure is achieved by pulling the tongue portion through an opening in the base portion and lockingly engaging neck areas of the tongue portion in corresponding areas of the tongue portion. Both these devices suffer the disadvantage of requiring the user to bear the expense and keep track of a number of small, easily lost pieces. Further, it is possible that during use sharp edges on these items could damage the bag precluding reuse of the bag. An additional disadvantage is that once the fully loaded bag has been picked up, the closure device could become very tightly jammed into place and, thus, very difficult to remove.

Another approach for providing a bag closure is disclosed in U.S. Pat. No. 3,186,626 to Shvetz, the invention of which employs tie-strip portions created by perforations formed into the top of the bag. When the perforated areas are pulled two tie-straps are separated from the bag and can be tied together to provide closure. The major disadvantage of this method is that the resulting knot is extremely difficult to loosen. The forces generated when a knotted plastic bag is picked up close the knot so tightly that destruction of the bag may be required in order to gain access to the contents.

This disadvantage is shared by the closure of U.S. Pat. No. 5,044,775 to Rutledge which utilizes plastic film tie elements which are welded to the end portion and adjacent to the top of the bag. When engaged, the tie element of that invention creates a tightly bunched neck area held secure by the tie element. Again, once this closure is engaged on a fully loaded bag, it is extremely difficult to disengage the closure without possibly damaging the bag.

U.S. Pat. No. 3,865,303 to Korn also discloses a pair of tieing strips anchored at one end of the bag described therein. The free ends of the tieing strips are insertable through openings provided in the bag walls. After insertion through the openings the strips are pulled to effect a constriction of the mouth of the bag and the free ends of the strips are tied together. Once any fully loaded bag, particularly a plastic bag, has been closed using a knot in the bag material, the resulting knot can be difficult, if not impossible, to open without rendering the bag unusable. Thus the ability to reuse the bag is lost.

U.S. Pat. No. 4,273,174 to Potter discloses a handbag having two integral strap-loops. The strap-loops can be folded one atop the other to effect a loose closure to the bag. Such an approach is not acceptable for loaded plastic bags because when similarly constructed handles of those bags are so engaged, the contents of the bag will spill out when the bag is tipped over.

As can be seen, the many attempts to provide a bag closure have disadvantages that render the bag difficult to open after closure, may damage the bag during opening after closure, or may require the extra cost and effort of a separate closure device. The present invention represents a significant advance because it avoids those disadvantages, providing a closure that is easy to use, secure and easy to reopen after closure permitting reuse of the bag. Moreover, for bags suspended from a bag dispensing rack, the strap of the present invention provides a convenient means to pull the lead bag open for loading.

It is also possible to use the bag of the present invention in a bag dispensing system utilizing a pack of unitized bags. U.S. Pat. Nos. 5,183,158 to Boyd et al. and 4,989,732 to Smith, the contents of which are incorporated herein by reference in their entirety, describe a pack of unitized bags which are releasably connected such that when one bag is pulled from the dispensing rack after loading, the next bag in the pack is pulled open. That releasable connection can also be achieved using the easy-open bag pack, method of forming and system disclosed in U.S. Pat. No. 5,507,713, the contents of which are incorporated herein by reference in their entirety. That application discloses a bag pack made up of bags that have been subjected to a corona discharge treatment. The corona treatment is sufficient to cause adjacently facing treated surfaces of adjacent bags within the bag pack to releasably fuse to each other upon a localized application of force using a novel upper and lower anvil means. These and other advantages and features of the invention will be readily apparent to one of ordinary skill in the art upon an examination of the specification and drawings herein.

SUMMARY OF THE INVENTION

In accordance with the present invention, there is provided a closeable thermoplastic bag comprising a front wall, a rear wall, gussetted side walls connecting the front and rear walls; an open mouth defined by the front, rear, and side walls; handles, extending upwardly from either side of the open mouth, the handles being integral extensions of the walls and having an inside edge and an outside edge; a strap having a first end and a second end attached to the front wall at the ends, defining an opening between the strap and the front wall, whereby the handles can be grasped and pulled through the opening so as to close the open mouth securely thereby preventing articles contained within the bag from falling out when the bag is tipped over. The strap is positioned adjacent to the bag mouth so as to open the mouth when the strap is pulled. The ends of the strap form two attachment zones.

Additionally, according to this invention, there is provided a flexible undershirt bag having side walls and open top disposed between spaced handle portions, the handle portions having an inside edge, an outside edge and extending upward from the side walls and having an improved closure comprising a thin flexible closure member attached to the front bag wall and adjacent to the handles forming an opening between the member and the front wall adapted to accommodate a human hand during closure by grasping and pulling the handle portions through the closure member so as to close the open mouth securely, thereby preventing articles contained within the bag from falling out when the bag is tipped over. The strap is positioned adjacent to the mouth so as to open the mouth when the strap is pulled.

The advantages of this invention over other types of bag closures are numerous. The closure member is integral to the bag so that no separate device or piece need be bought or inventoried. The closure also acts as a handle providing an easy means for the bag to be pulled from a unitized bag pack. This bag can be closed with a quick, one-handed operation. The opening between the closure member and the bag wall can be sized to accommodate a large hand, yet still provide ease of operation and secure closure. This invention enables the consumer to reuse bags of all types because the closure can be reopened without damaging the bag. Thus the value of the bag to the consumer is greatly increased.

Therefore, it is an object of this invention to provide a thermoplastic bag which can be closed securely with one hand.

It is another object of this invention to provide a closeable thermoplastic bag which can be easily reopened after closure without damaging the bag.

It is still another object of this invention to provide a thermoplastic bag having a closure member positioned on the front wall of the bag just below the bag mouth.

It is yet another object of this invention to provide a bag that can be closed so that the articles contained therein will not spill out when the bag is tipped over.

Still another object of this invention is to provide a bag having a closure member that can be used as a handle to pull the bag open from a unitized pack of bags.

Other objects and the several advantages of the present invention will become apparent to those skilled in the art upon a reading of the specification and the claims appended thereto. The invention itself, together with further objects and attendant advantages, will best be understood by reference to the following detailed description, taken in conjunction with the accompanying drawings.

DETAILED DESCRIPTION OF THE INVENTION

Figure 1:
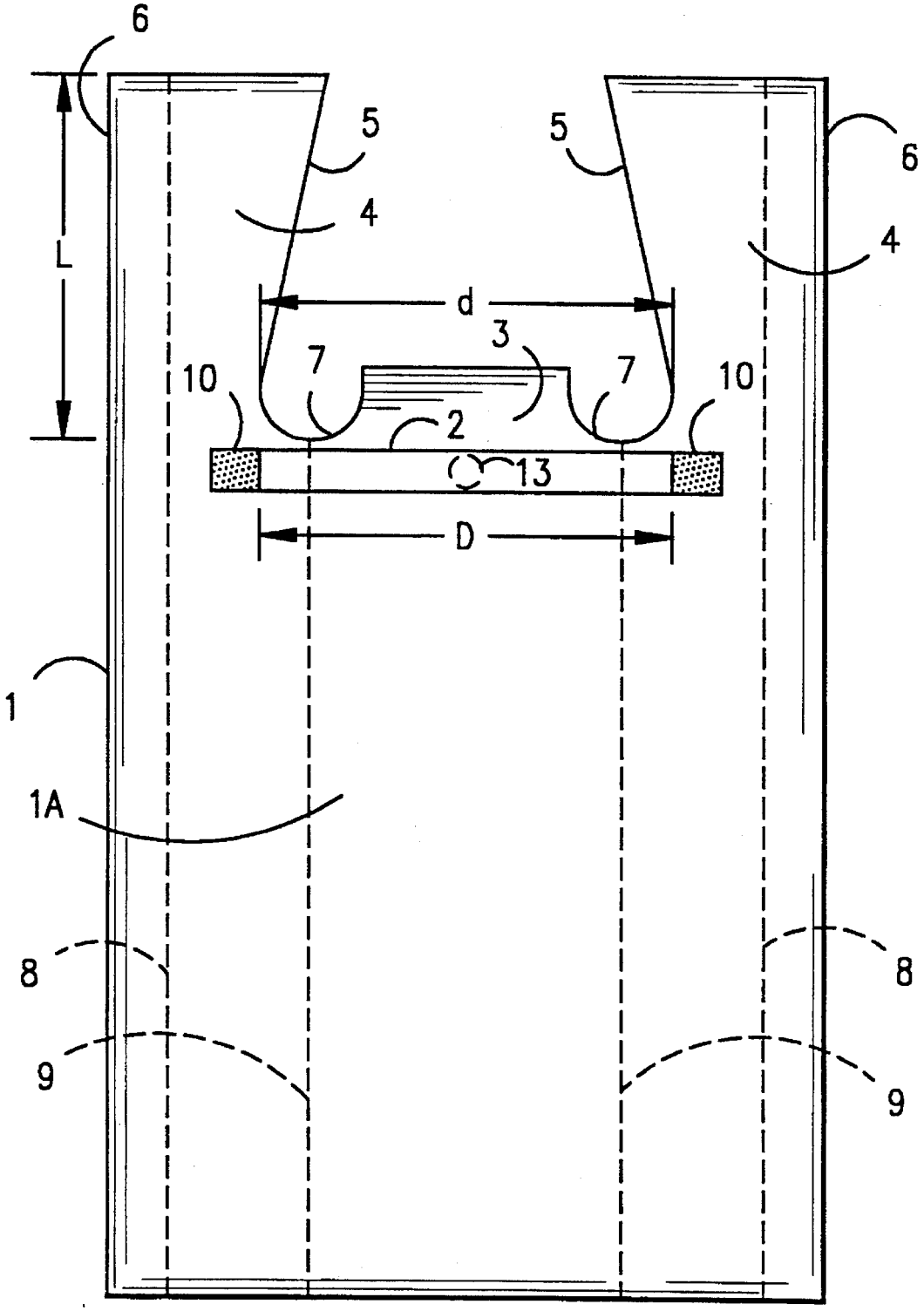
FIG. 1 is an elevation of the bag showing the closure strap positioned just below the mouth of the bag.

The present invention is directed to a novel bag that can be closed in such a manner that the contents of the bag will not fall out when the bag is tipped over. The bag closure is simple to use requiring only one hand to operate. FIG. 1 is an elevation of the bag 1, also known as undershirt bag, showing the closure strap 2 attached to the front wall 1A of the bag. The closure strap 2 is centered on the front wall 1A of the bag from side to side and is positioned just below the mouth 3 of the bag. The importance of the distance between the top edge of the strap and the mouth of the bag is discussed further herein. Although a strap is shown and discussed herein, it to be understood that any thin, substantially flexible member of sufficient strength and configuration to perform as described herein may be used to carry out the present invention. The terms strap or member herein both refer to the same element of this invention.

The bag has two handles 4 which are integral extensions of the front, rear and side walls. Each of the handles has an inside edge 5 and an outside edge 6. The lower end of each inside edge 5 terminates in an arcuate area 7 that functions as a stress relief notch as shown in U.S. Pat. No. Re. 34,019 to Kuklies et al., the disclosure of which is incorporated herein by reference in its entirety. The stress relief notches reduce the tendency of some thermoplastic bags to tear during loading and carrying.

FIG. 1 also shows a triple gusset arrangement whereby the gussetted side walls of the bag are connected to the front bag wall and rear bag wall by two pleats 8. The pleats 9 are about a third of the depth of the gussets 9 in the side walls. This arrangement is used to increase the usable bag volume for a given bag face dimension. The face dimension is the width of the bag in the lay-flat condition. The present invention is also intended to be used with other undershirt bags not having the triple gusset arrangement.

Figure 2:
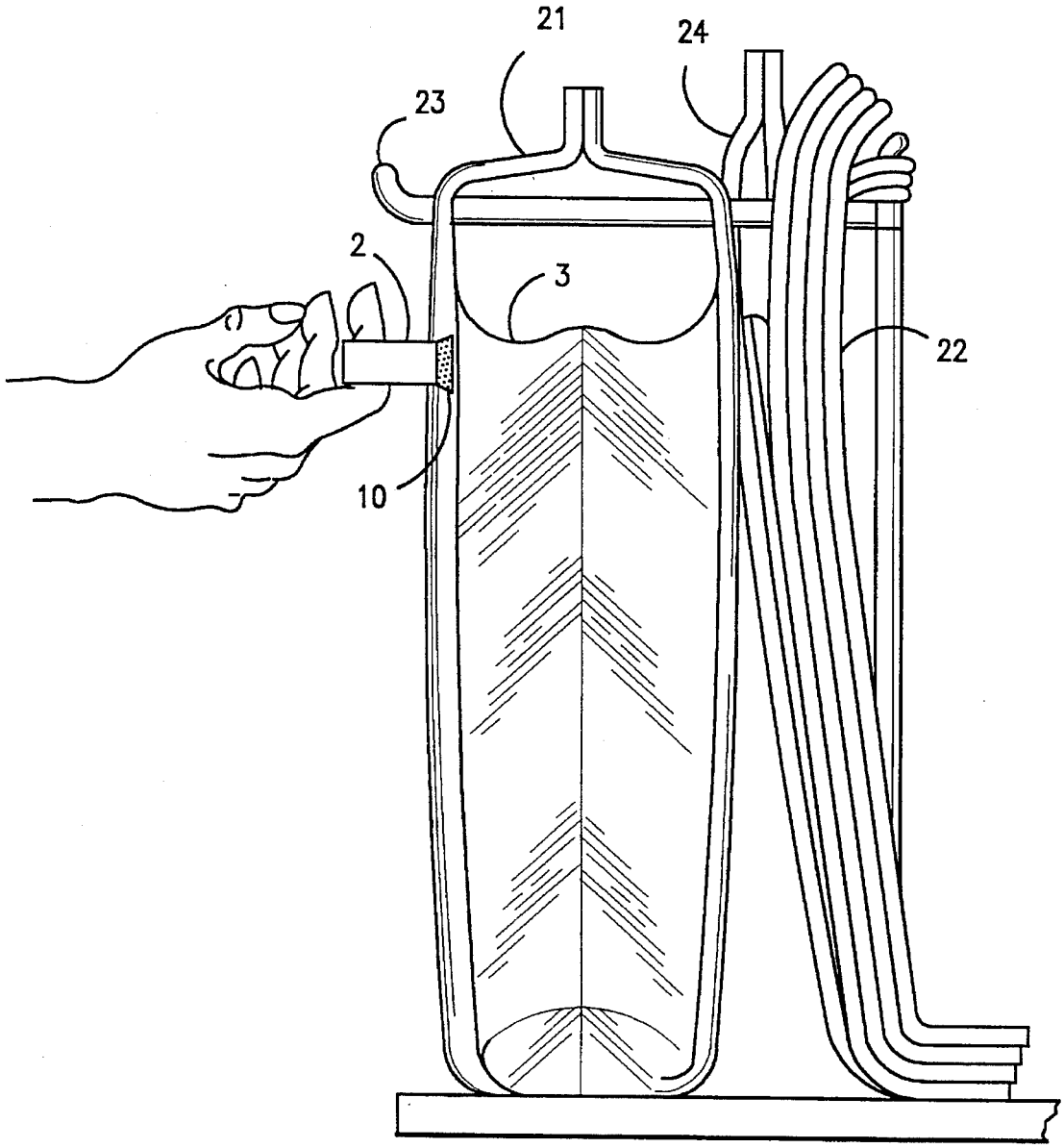
FIG. 2. is a side view showing the closure strap being used to pull open a lead bag from a unitized pack of bags.

Turning now to FIG. 2, it can be seen that the closure strap 2 can be used to pull open the lead bag 21 in a unitized pack 22 of bags suspended from substantially parallel support rods 23 of the type commonly known in the art. The lead bag 21 is releasably connected to the next bag 24 in the pack. As the loaded lead bag is pulled from the pack the releasable connection serves to open the mouth of the next bag. The positioning of the attachment zones 10 near the bag mouth 3 helps to open the lead bag 21 fully. The closure strap 2 provides a more convenient, easy to grasp means for the user to open the lead bag.

The closure strap 2 can be fabricated from any thin, flexible material. Preferably, it is constructed of polyethylene which is at least 0.0254 mm (1 mil) thick and still more preferably from about 0.0254 (1) to 0.13 mm (5 mils) thick. Though the thickness may vary, desirably it should be thicker than the bag wall material. The strap may be fabricated from any other suitable plastic material that does not stretch excessively when pulled to open a bag pack. Suitable materials include, but are not limited to, linear low density polyethylene, high density polyethylene, and low density polyethylene. The term polyethylene is intended to include both homopolymers of ethylene and also copolymers of ethylene. Generally, the lower the stretch modulus of the strap material the better the performance of the strap.

The physical size of the strap may vary proportionally with the size of the bag on which it is installed. To consider a non-limiting example, for a grocery bag of size about 55.9 cm (22 in) in overall height and about 30.5 cm (12 in) in width, a suitable strap size would be about 20.3 cm (8 in) in width and about 1.91 cm (¾ in) to about 2.54 cm (1 in) in height. The attachment zones 10 on that size strap should preferably be about 2.03 (0.8) to about 03.05 (1.2) cm (in) wide. As the bag dimensions are changed to meet the needs of each particular use, the strap dimensions may also be varied to provide secure closure. In order to ensure adequate performance of the closure, the combined area of the attachment zones 10 should be about 18% to about 30% of the area of the closure strap 2.

Figure 3:
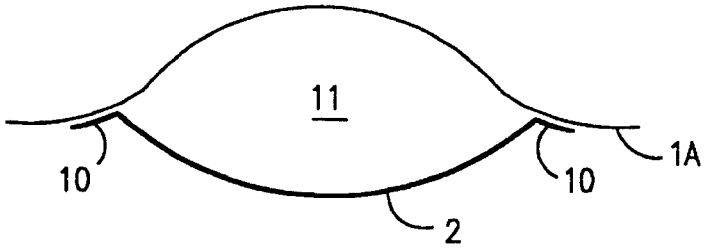
FIG. 3 is a top view of the bag showing the opening defined by the closure strap and the front wall of the bag.
Figure 4:
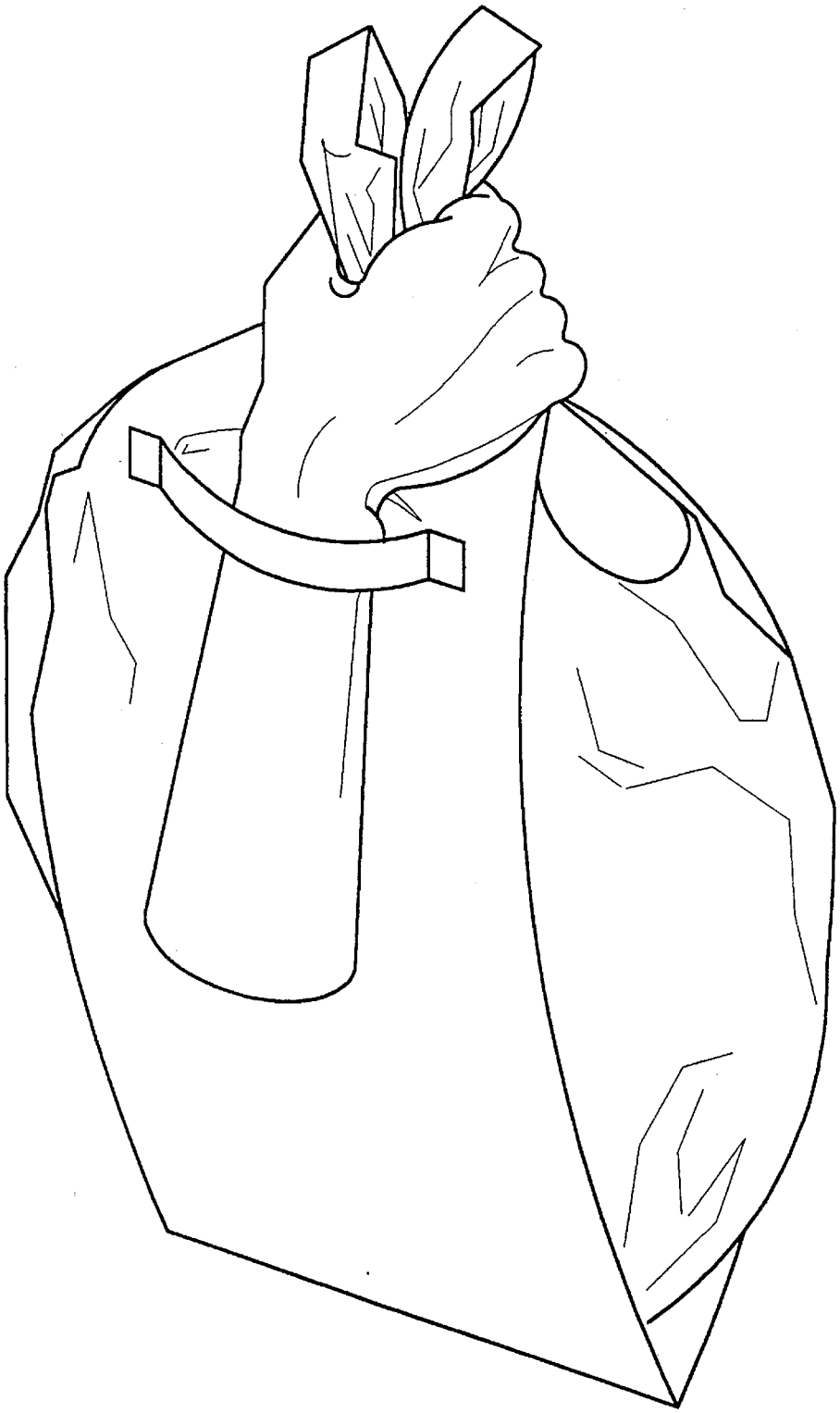
FIG. 4. is a perspective view showing the user's hand inserted through the opening of FIG. 3 and grasping the bag handles.
Figure 5:
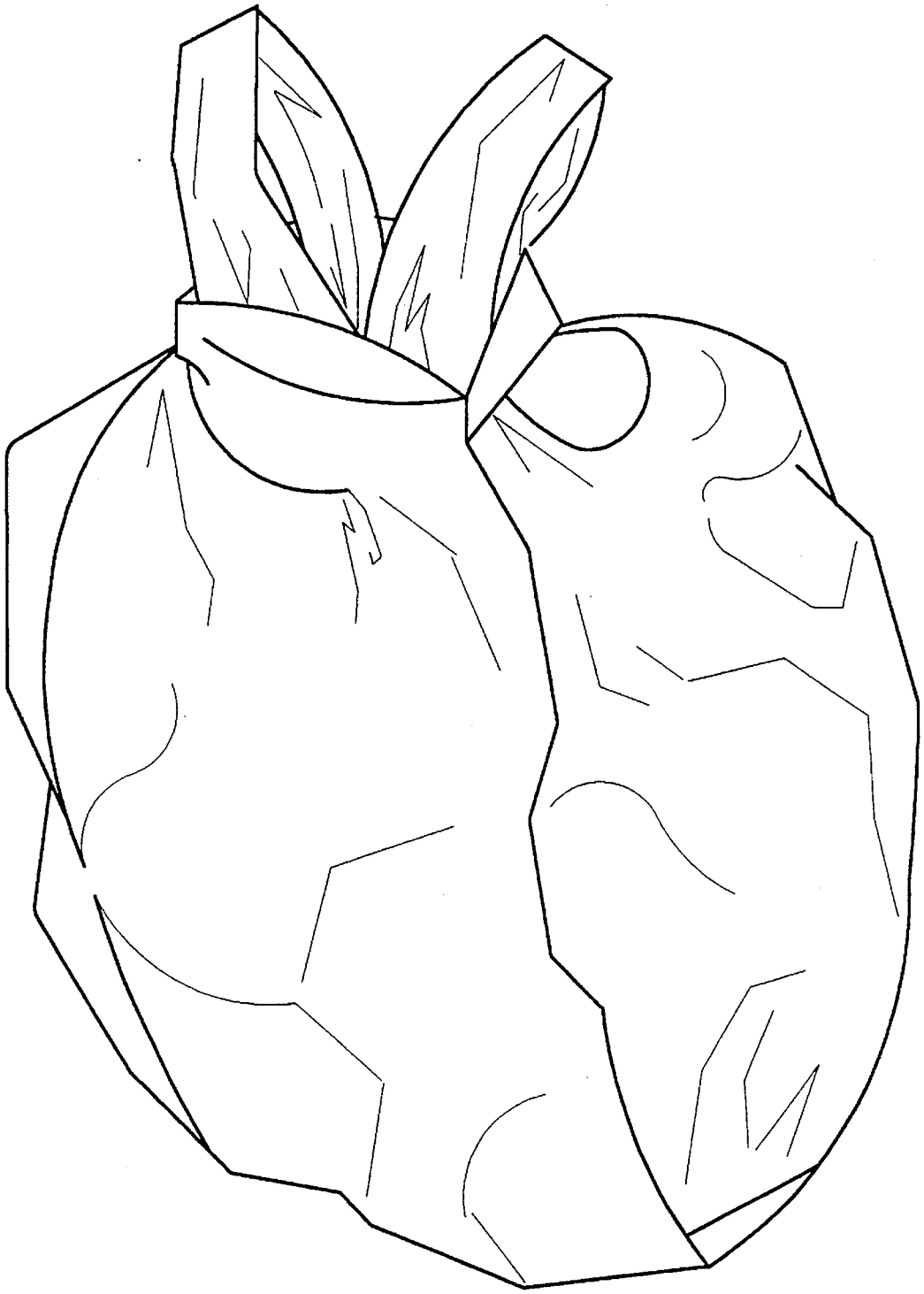
FIG. 5 is a perspective view of the bag in the closed condition with the handles pulled through the opening of FIG. 3.

The strap is attached to the bag via two attachment zones 10 located at the ends of the strap. These zones are spaced apart to create a large enough opening 11 as shown in FIG. 3 between the strap 2 and bag front wall 1A so that a user's hand can be inserted through that opening to grasp the handles as shown in FIG. 4. The opening 11 must be large enough to accommodate the user's hand but small enough to hold the bag closed as shown in FIG. 5. Turning now to FIG. 1, it can be seen that the inside edges of the attachment zones 11 are in approximate alignment with the inside edges 5 of the handles. The distance (D) between the inside edges of the attachment zones should be maintained slightly larger than the distance (d) between the inside edges 5 of the handles 4. The overall width of the closure strap 2 will preferably be greater than distance (d) such that the closure strap 2 extends beyond both inside edges 5. The relationship between strap width and bag width can be described by the ratio of the width of the strap to the width of the bag. That ratio should be about 2:3 to about 3:4. Although this closure may be installed on many different types of thermoplastic bags, it is contemplated that the strap will preferably have a width less than that of the bag on which it is installed.

Figure 6:
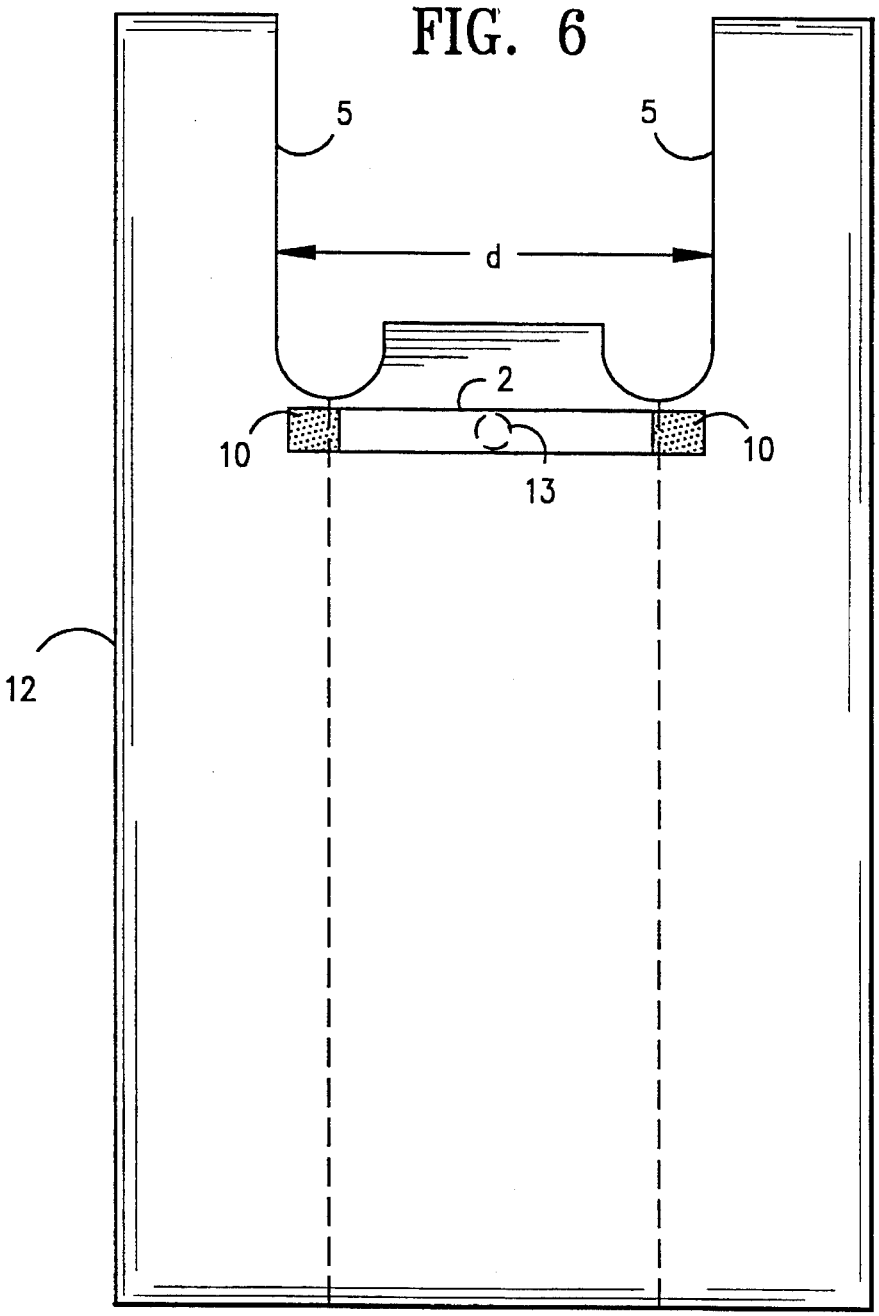
FIG. 6 is an elevation of the closure strap positioned on a very large bag.

As mentioned earlier the present invention is adaptable to a wide range of sizes of thermoplastic bags. When the bag size increases substantially from that in the embodiment described above, strap positioning criteria do not change but strap sizing criteria may be adjusted. FIG. 6 shows an elevation of a very large bag 12 with the closure strap 2 positioned thereon. By a very large bag it is meant a bag of about 38.1 cm (15 in) to about 45.7 cm (18 in) in width and about 71.1 cm (28 in) to about 81.2 cm (32 in) in overall height. Such a bag can have a distance (d) between handle inside edges 5 of about 25.4 cm (10 in) to about 35.6 cm (14 in). Referring again to FIG. 6 it can be seen that as used on a very large bag, the overall width of the closure strap can be reduced to about the distance (d) between inside handle edges 5. A savings on strap material costs may be achieved since satisfactory closure performance will take place with a less wide strap. In the very large bag application, the attachment zones 10 should comprise the same proportion of the overall strap area as described above.

Attachment of the closure strap 2 to the front wall of the bag is achieved using any method that will produce a bond that has at least as much strength as the bag wall. The bond should be sufficiently strong to prevent delamination of the closure member from the bag wall when the bag is fully loaded and being transported and also when the closure member is used to pull open a lead bag from a unitized pack. One method of attaching the strap to the bag wall is ultrasonic welding. This technique is well known in the art and will not be discussed in detail herein. More preferably the bond is accomplished by using in the attachment zones a pressure sensitive, double-sided adhesive tape. This type of tape is commonly known in the art and can be dispensed, stripped, cut and applied automatically. Still more preferred is the use of an adhesive coating. This adhesive material can be a glue that will produce a bond of the strength described above. The glue can be either acrylic or water-based. A further important characteristic of the glue is that it should not contaminate scrap bag material that is recycled for the manufacture of new bags. Typically scrap material is ground up and added to virgin material as it is fed into the manufacturing apparatus. An unsuitable glue would cause film break in the material used to construct the bag walls resulting in costly waste of material.

It is desirable to provide a means to prevent the closure member 2 from sagging when installed on the bag 1. Accordingly the present invention contemplates the installation of a tacky area 13 as shown on FIG. 1 centered on the surface of the closure member facing the front wall of the bag. A corresponding tacky area is provided on the bag front wall in alignment with the tacky area on the closure member. Mating the two bag components will lightly tack the closure member to the bag thereby preventing sag. This measure also holds the closure member in place until the bag is ready for use. The joining of the closure member to the bag wall is cohesive rather that an adhesive in that the resulting bond will be temporary. It is not intended that this bond have the high adhesive strength of the attachment zones 10. Rather the bond should be sufficient to prevent any sag in the closure member from the time the member is applied to the bag until the time the bag is pulled open for loading. The shape of the tacky areas can be circular, square or some other shape so long as a sufficient amount of cohesive material is applied.

As discussed above, the closure strap should be positioned on the bag wall just below the bag mouth. That positioning is important; because if the handle is positioned too far below the bag mouth, it will be difficult for the user to insert his hand through the opening 11 to grasp the handles 4 as shown in FIG. 4. Moreover, as the strap position is lowered on the bag wall, the forces generated in the attachment zones 10 while carrying a fully loaded bag will be greatly increased thereby raising the likelihood of attachment failure. Strap position has a significant effect on both ease of use and potential closure failure. It has been found that the distance from the top of the strap the to the bag mouth should not be more than about 2.54 cm (1 in).

The closure strap can be installed on any type of thermoplastic bag having handles 4 long enough to achieve closure using the strap and still provide an adequate grip to the user. Handles that are too short may not hold the bag closed securely when the bag is tipped over. The proper functioning of the present invention may require a handle length that is longer than that common in the art. Handle length as referred to herein means the length L, shown in FIG. 1. Preferably the handle length is about 15.2 cm (6 in) to about 20.3 cm (8 in). Particularly preferred is a handle length of about 17.8 cm (7 in). FIG. 4 shows the first of the two steps involved in using the closure of the present invention on a thermoplastic film bag. The user first inserts a hand through the opening 11 from below and grasps both handles 4 firmly. The handles are then pulled down through the opening with the user's hand passing through the opening a second time. The handles are then pulled straight up to a vertical final closure position as shown in FIG. 5. The bag is now ready for pickup and transport away from the point of loading. FIG. 5 further illustrates that the closure strap 2 tensions the handles when the bag is picked up to form a secure closure of the bag mouth 3. The strap is also tensioned when the bag is tipped over so as to prevent the articles contained therein from spilling out. An additional advantage of the present invention is the easy manner in which the closed bag may be reopened for unloading. When the bag is at rest the closure strap relaxes, allowing the handles to be pulled back through the strap with ease. Thus, the bag can be closed securely, reopened and reused without damage to the bag.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims.

What is claimed is:

1. A bag comprising:

a front wall, a rear wall, and side walls bridging said front and rear walls, said front wall, said rear wall, and said side walls forming an open mouth of said bag;

handles extending upwardly from one or more of said front wall, said rear wall, and said side walls, each of said handles including an inside edge and an outside edge; and an elongated closure member closely adjacent to and below said open mouth and having opposing ends attached to said front wall adjacent to said handles, said closure member defining an opening between said closure member and said front wall adapted to accommodate a human hand during closure by grasping and pulling said handles through said opening to close said open mouth, said strap having a width less than the width of said bag and greater than or approximately equal to a distance between said inside edges of said handles.

2. The bag of claim 1 wherein said elongated closure member is free of any apertures therein.

3. The bag of claim 1 wherein said elongated closure member has a width less than a width of said bag and greater than or approximately equal to a distance between said inside edges of said handles.

4. In a flexible undershirt bag having side walls and open mouth disposed between spaced handle portions, said handle portions having an inside edge, an outside edge and extending upwardly from the side walls, an improved closure comprising:

a thin flexible closure member attached to the front bag wall and adjacent to the handles forming an opening between the member and the front wall adapted to accommodate a human hand during closure by grasping and pulling said handle portions through said opening so as to close said open mouth securely thereby preventing articles contained within said bag from falling out when said bag is tipped over, said member positioned adjacent to said mouth so as to open said mouth when said strap is pulled, said member having a width less than the width of said bag and greater than or approximately equal to a distance between said inside edges of said handles.

5. The bag of claim 4 wherein said member is attached to said front wall by an adhesive.

6. The bag of claim 5 wherein said member is from about 1 mil to 5 mil thick.

7. The bag of claim 6 wherein said member is constructed predominantly of polyethylene.

8. The bag of claim 7 wherein said member has first and second ends attached to said front wall and said member has a width defined by a distance between said first and second ends, and wherein the ratio of the width of said member to the width of said bag is about 2:3 to about 3:4.

9. The bag of claim 8 wherein the width of said member is greater that the width defined by the distance between the said inside edges of said handles.

10. The bag of claim 9 wherein the length of said handles is from about 6 inches to about 8 inches.

11. The bag of claim 10 wherein said member is positioned on said front wall at a distance of from just below said mouth of said bag to about 1 inch below said mouth of said bag.

12. A bag for containing articles comprising:

(a) a front wall;

(b) a rear wall;

(c) gussetted side walls connecting said front and rear walls;

(d) an open mouth defined by said front wall, rear wall and side walls;

(e) handles extending upwardly from either side of said open mouth, said handles being integral extensions of said walls and having an inside edge and an outside edge;

(f) a strap having a first end and a second end attached to said front wall at said first and second ends and adjacent to the handles defining an opening between said strap and said front wall adapted to accommodate a human hand during closure by grasping and pulling said handle portions through said opening so as to close said open mouth securely thereby preventing articles contained within said bag from falling out when said bag is tipped over, said strap positioned closely adjacent to and below said mouth so as to open said mouth when said strap is pulled, said ends forming two attachment zones, said strap having a width defined bag a distance between said first and second ends, said width being less than the width of said bag and greater than or approximately equal to a distance between said inside edges of said handles.

13. The bag of claim 12 wherein said strap is attached to said front wall by an adhesive.

14. The bag of claim 12 wherein said strap is from about 1 mil to 5 mil thick.

15. The bag of claim 12 wherein said strap is constructed predominantly of polyethylene.

16. The bag of claim 12 wherein the ratio of the width of said strap to the width of said bag is about 2:3 to about 3:4.

17. The bag of claim 12 wherein the length of said handles is from about 6 inches to 8 inches.

18. The bag of claim 12 wherein the width of said strap is greater that the width defined by the distance between the inside edges of said handles.

19. The bag of claim 12 wherein said attachment zones comprise about 18% to about 30% of the surface area of said strap.

20. A bag for containing articles comprising:

(a) a front wall;

(b) a rear wall;

(c) gussetted side walls connecting said front and rear walls;

(d) an open mouth defined by said front wall, rear wall and side walls;

(e) handles extending upwardly from either side of said open mouth, said handles being integral extensions of said walls and having an inside edge and an outside edge;

(f) a strap having a first end and a second end attached to said front wall at said first and second ends deflating an opening between said strap and said front wall whereby said handles can be grasped and pulled through said opening so as to close said open mouth securely thereby preventing articles contained within said bag from falling out when said bag is tipped over, said strap positioned closely adjacent to and below said mouth so as to open said mouth when said strap is pulled, said ends forming two attachment zones, said strap being positioned on said front wall at a distance of from just below said mouth of said bag to about 1 inch below said mouth of said bag.

* * * * *